US007045699B2

(12) United States Patent
Okabayashi

(10) Patent No.: US 7,045,699 B2
(45) Date of Patent: May 16, 2006

(54) MIXING METHOD, MIXING APPARATUS, AND PROGRAM FOR IMPLEMENTING THE MIXING METHOD

(75) Inventor: Masaaki Okabayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 183 days.

(21) Appl. No.: 10/674,265

(22) Filed: Sep. 26, 2003

(65) Prior Publication Data

US 2004/0071301 A1 Apr. 15, 2004

(30) Foreign Application Priority Data

Sep. 30, 2002 (JP) ..... 2002-284973

(51) Int. Cl.
*G10H 1/08* (2006.01)

(52) U.S. Cl. ..... 84/625; 381/119

(58) Field of Classification Search ..... 84/622, 84/625, 659, 660, 692, 697; 341/110; 370/460; 381/119, 18; 348/590, 593; 359/326; 700/94; 369/4

See application file for complete search history.

(56) References Cited

U.S. PATENT DOCUMENTS 6,218,971 B1 * 4/2001 Sugihara ..... 341/110
2002/0189426 A1 * 12/2002 Hirade et al. ..... 84/603

FOREIGN PATENT DOCUMENTS

EP 1 058 414 A2 12/2000
JP 07-015284 1/1995

* cited by examiner

*Primary Examiner*—David Martin
*Assistant Examiner*—Jianchun Qin
(74) *Attorney, Agent, or Firm*—Morrison & Foerster LLP

(57) ABSTRACT

There is provided a mixing method which is executed by a mixing apparatus and enables cascade connection without providing the mixing apparatus with any terminals used exclusively for cascade connection. The mixing method is executed by a first mixing apparatus including a plurality of input terminals when a second mixing apparatus is connected in cascade to part of the input terminals of the first mixing apparatus. At least one audio signal input to part of the plurality of input terminals is set as at least one cascade signal supplied from the second mixing apparatus. Arithmetic operations are performed on at least one audio signal input to at least one input terminal other than the part of the plurality of input terminals. The at least one cascade signal and the at least one audio signal on which the arithmetic operations have been performed are mixed.

9 Claims, 5 Drawing Sheets

[ INPUT (OUTPUT) COMPUTING DEVICE ]

[ INPUT ASSIGNMENT SETTING SCREEN VIEW ]

[ CASCADE LINE SETTING SCREEN VIEW ]

[ OUTPUT ASSIGNMENT SETTING SCREEN VIEW ]

MIXING METHOD, MIXING APPARATUS, AND PROGRAM FOR IMPLEMENTING THE MIXING METHOD

BACKGROUND OF THE INVENTION

1. Field of the Invention

The present invention relates to a mixing method and a mixing apparatus that can be suitably applied to musical instruments capable of being connected in cascade, as well as a program for implementing the mixing method.

2. Description of the Related Art

Conventionally, a mixing apparatus has been known which is capable of processing and mixing a plurality of audio signals and to which other mixing apparatuses can be connected in cascade.

For example, a mixing apparatus of this type has been disclosed in Japanese Laid-Open Patent Publication (Kokai) No. 7-015284. This mixing apparatus is capable of causing a delay circuit thereof to delay an audio signal directly input to the mixing apparatus and mixing the delayed audio signal and a cascade signal input from another mixing apparatus via a cascade connection terminal of the mixing apparatus. The mixing apparatus is also capable of outputting the mixed signal to another mixing apparatus via the cascade connection terminal of the mixing apparatus.

However, the mixing apparatus disclosed in Japanese Laid-Open Patent Publication (Kokai) No. 7-015284 has problems described below. That is, the manufacturing cost is increased since the cascade connection terminal is provided exclusively for cascade connection with another mixing apparatus. The cascade connection terminal is unnecessary for a user who does not intend to connect mixing apparatuses in cascade.

SUMMARY OF THE INVENTION

It is therefore an object of the present invention to provide a mixing method which is executed by a mixing apparatus and enables cascade connection without providing the mixing apparatus with any terminals used exclusively for cascade connection, and the mixing apparatus, as well as a program for implementing the mixing method.

To attain the above object, in a first aspect of the present invention, there is provided a mixing method executed by a first mixing apparatus including a plurality of input terminals when a second mixing apparatus is connected in cascade to part of the input terminals of the first mixing apparatus, comprising an input setting step of setting at least one audio signal input to part of the plurality of input terminals as at least one cascade signal supplied from the second mixing apparatus, an input computing step of performing arithmetic operations on at least one audio signal input to at least one input terminal other than the part of the plurality of input terminals, and a signal mixing step of mixing the at least one cascade signal and the at least one audio signal on which the arithmetic operations have been performed in the input computing step.

According to the first aspect of the present invention, it is possible to connect part of the plurality of input terminals in cascade without providing input terminals exclusively for cascade connection.

Preferably, the input computing step comprises a delaying step of performing a delay process for correcting a time of delay from the second mixing apparatus to the first mixing apparatus.

To attain the above object, in a second aspect of the present invention, there is provided a mixing method executed by a second mixing apparatus when the second mixing apparatus is connected in cascade to input terminals of a first mixing apparatus, comprising a mixing step of mixing a plurality of input signals to output a plurality of output signals, an output setting step of setting part of the plurality of output signals as at least one cascade signal to be supplied to the first mixing apparatus, a computing and outputting step of performing arithmetic operations on at least one output signal other than the part of the plurality of output signals, and outputting the at least one other output signal on which the arithmetic operations have been performed to the first mixing apparatus, and a cascade outputting step of directly outputting the part of the plurality of output signals set as the cascade signal to the first mixing apparatus.

According to the second aspect of the present invention, it is possible to output part of the output signals in cascade without providing input terminals exclusively for cascade connection.

To attain the above object, in a third aspect of the present invention, there is provided a mixing apparatus including a plurality of input terminals, part of the input terminals being connected in cascade to another mixing apparatus, comprising an input setting device that sets at least one audio signal input to part of the plurality of input terminals as at least one cascade signal supplied from the other mixing apparatus, an input computing device that performs arithmetic operations on at least one audio signal input to at least one input terminal other than the part of the plurality of input terminals, and a signal mixing device that mixes the at least one cascade signal and the at least one audio signal on which the arithmetic operations have been performed by the input computing device.

According to the third aspect of the present invention, it is possible to connect part of the plurality of input terminals in cascade without providing input terminals exclusively for cascade connection.

Preferably, the input computing device comprises a delaying device that performs a delay process for correcting a time of delay from the other mixing apparatus to the mixing apparatus.

To attain the above object, in a fourth aspect of the present invention, there is provided a mixing apparatus including a plurality of input terminals, part of the input terminals being connected in cascade to another mixing apparatus, comprising a mixing device that mixes a plurality of input signals to output a plurality of output signals, an output setting device that sets part of the plurality of output as at least one cascade signal to be supplied to the other mixing apparatus, a computing and output device that performs arithmetic operations on at least one output signal other than the part of the plurality of output signals, and outputs the at least one other output signal on which the arithmetic operations have been performed to the other mixing apparatus, and a cascade outputting device that directly outputs the part of the plurality of output signals set as the cascade signal to the other mixing apparatus.

According to the fourth aspect of the present invention, it is possible to output part of the output signals in cascade without providing input terminals exclusively for cascade connection.

To attain the above object, in a fifth aspect of the present invention, there is provided a program executed by a computer to cause a first mixing apparatus including a plurality of input terminals to execute a mixing method when a second mixing apparatus is connected in cascade to part of the input terminals of the first mixing apparatus, comprising an input setting module for setting at least one audio signal input to part of the plurality of input terminals as at least one cascade signal supplied from the second mixing apparatus, an input computing module for performing arithmetic operations on at least one audio signal input to at least one input terminal other than the part of the plurality of input terminals, and a signal mixing module for mixing the at least one cascade signal and the at least one audio signal on which the arithmetic operations have been performed by the input computing module.

According to the fifth aspect of the present invention, it is possible to connect part of the plurality of input terminals in cascade without providing cascade input terminals exclusively for cascade connection.

Preferably, the input computing module comprises a delaying module for performing a delay process for correcting a time of delay from the second mixing apparatus to the first mixing apparatus.

To attain the above object, in a sixth aspect of the present invention, there is provided a program executed by a computer to cause a second mixing apparatus to execute a mixing method when the second mixing apparatus is connected in cascade to input terminals of a first mixing apparatus, comprising a mixing module for mixing a plurality of input signals to output a plurality of output signals, an output setting module for setting part of the plurality of output signals as at least one cascade signal to be supplied to the first mixing apparatus, a computing and outputting module for performing arithmetic operations on at least one output signal other than the part of the plurality of output signals, and outputting the at least one other output signal on which the arithmetic operations have been performed to the first mixing apparatus, and a cascade outputting module for directly outputting the part of the plurality of output signals set as the cascade signal to the first mixing apparatus.

According to the sixth aspect of the present invention, it is possible to output part of the output signals in cascade without providing input terminals exclusively for cascade connection.

The above and other objects, features, and advantages of the invention will become more apparent from the following detailed description taken in conjunction with the accompanying drawings.

BRIEF DESCRIPTION OF THE DRAWINGS

FIGS. 5A to 5C are views showing examples of input setting screen views for cascade connection, in which:

FIG. 5A shows an example of a CASCADE_IN_PATCH setting screen view;

FIG. 5B shows an example of a CASCADE_IN_ATTENUATION setting screen view; and FIG. 5C shows an example of a CASCADE_OUT_PATCH setting screen view.

DETAILED DESCRIPTION OF THE PREFERRED EMBODIMENTS

The present invention will now be described in detail with reference to the drawings showing a preferred embodiment thereof.

Figure 1:
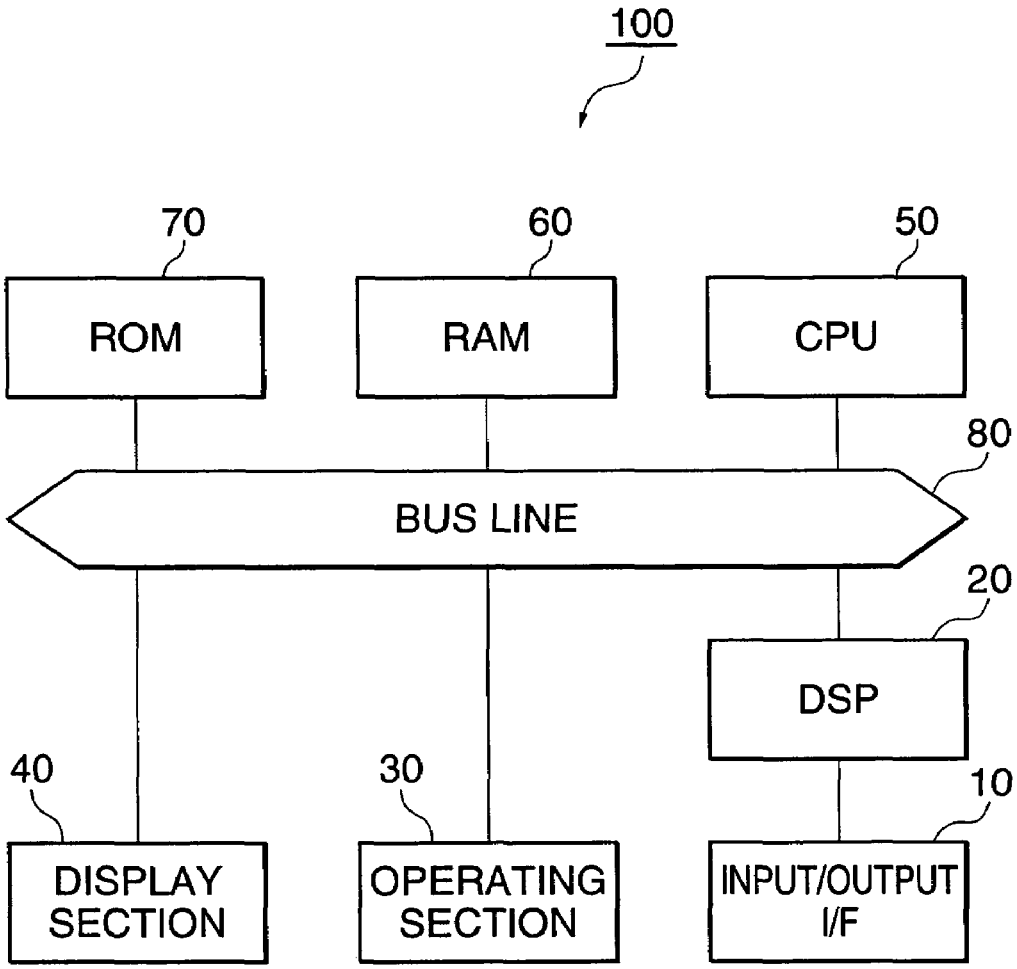
FIG. 1 is a diagram showing the hardware construction of a mixing apparatus 100 according to an embodiment of the present invention.
Figure 2:
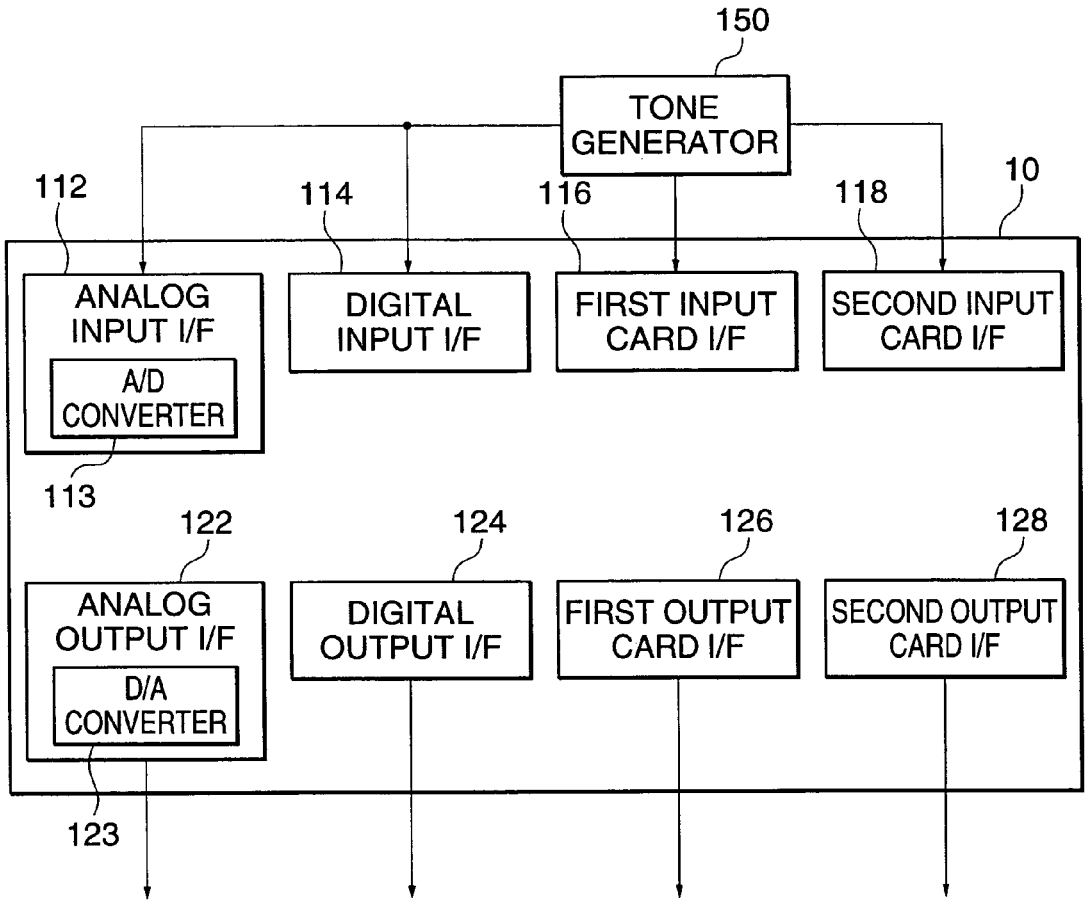
FIG. 2 is a diagram showing the concrete construction of an input/output interface of the mixing apparatus 100 in FIG. 1.

FIG. 1 is a diagram showing the hardware construction of a mixing apparatus 100 according to an embodiment of the present invention, and FIG. 2 is a diagram showing the concrete construction of an input/output interface of the mixing apparatus 100 in FIG. 1.

In FIGS. 1 and 2, reference numeral 10 denotes an input/output interface which is comprised of a plurality of interfaces such as an analog input interface 112, a digital input interface 114, a first input card interface 116, a second input card interface 118, an analog output interface 122, a digital output interface 124, a first output card interface 126, and a second output card interface 128, and which provides interface for input and output of audio signals (such as sound signals and musical tone signals).

The analog input interface 112 is provided with an A/D converter 113, and the analog output interface 122 is provided with a D/A converter 123. It is configured such that an input card or an output card is inserted into each of respective slots of the first and second input card interfaces 116 and 118 or the first and second output card interfaces 126 and 128. Analog format audio signals (hereinafter referred to as "analog audio signals") are input via the analog input interface 112, and digital format audio signals (hereinafter referred to as "digital audio signals") are input via the digital input interface 114 and the first and second input card interfaces 116 and 118. These audio signals are directly input from a tone generator 150. Further, each input interface is provided with input terminals via which audio signals are input, and each output interface is provided with output terminals via which audio signals are output. Therefore, a plurality of audio signals are input via the plurality of input terminals provided in the plurality of input interfaces (the analog input interface 112, the digital input interface 114, and the first and second input card interfaces 116 and 118), and a plurality of audio signals are output via the plurality of output terminals provided in the plurality of output interfaces (the analog output interface 122, the digital output interface 124, and the first and second output card interfaces 126 and 128).

In the case where another mixing apparatus is connected in cascade to any of the input interfaces of the mixing apparatus 100, a cascade signal is input from the other mixing apparatus. That is, any of the input audio signals is the cascade signal, and the audio signal input via the cascade connection and the audio signals input directly from the tone generator 150 are input via the plurality of input terminals. With the above construction of the input interfaces, among a plurality of mixing apparatuses connected in cascade, the mixing apparatus 100 can be a downstream mixing apparatus, i.e. a mixing apparatus that receives the cascade signal. On the other hand, analog audio signals are output via the analog output interface 122, and digital audio signals are output via the digital output interface 124 and the first and second output card interfaces 126 and 128. It should be noted that another mixing apparatus may be connected to any of the output interfaces, and a cascade signal may be output to the other mixing apparatus. Namely, the mixing apparatus 100 can be an upstream mixing apparatus among a plurality of mixing apparatuses connected in cascade, i.e. a mixing apparatus that transmits the cascade signal.

In FIG. 1, reference numeral 20 denotes a DSP (Digital Signal Processor), which is connected to the input/output interface 10 and performs digital signal processing on various input signals. Reference numeral 30 denotes an operating section, which is comprised of a variety of switches and a pointing device. Reference numeral 40 denotes a display section, which is comprised of a liquid crystal display panel. Reference numeral 50 denotes a CPU, which controls various component parts. Reference numeral 60 denotes a RAM, which functions as a work memory. Reference numeral 70 denotes a ROM, which stores control programs. Note that a variety of parameters are stored in a flash memory, not shown. Reference numeral 80 denotes a bus line, which connects the component parts to each other. The above described component parts constitute the mixing apparatus 100 according to the present embodiment.

A description will now be given of the structure of a mixing algorithm that is executed by the DSP 20, the CPU 50, and so forth with reference to FIG. 3.

Figure 3:
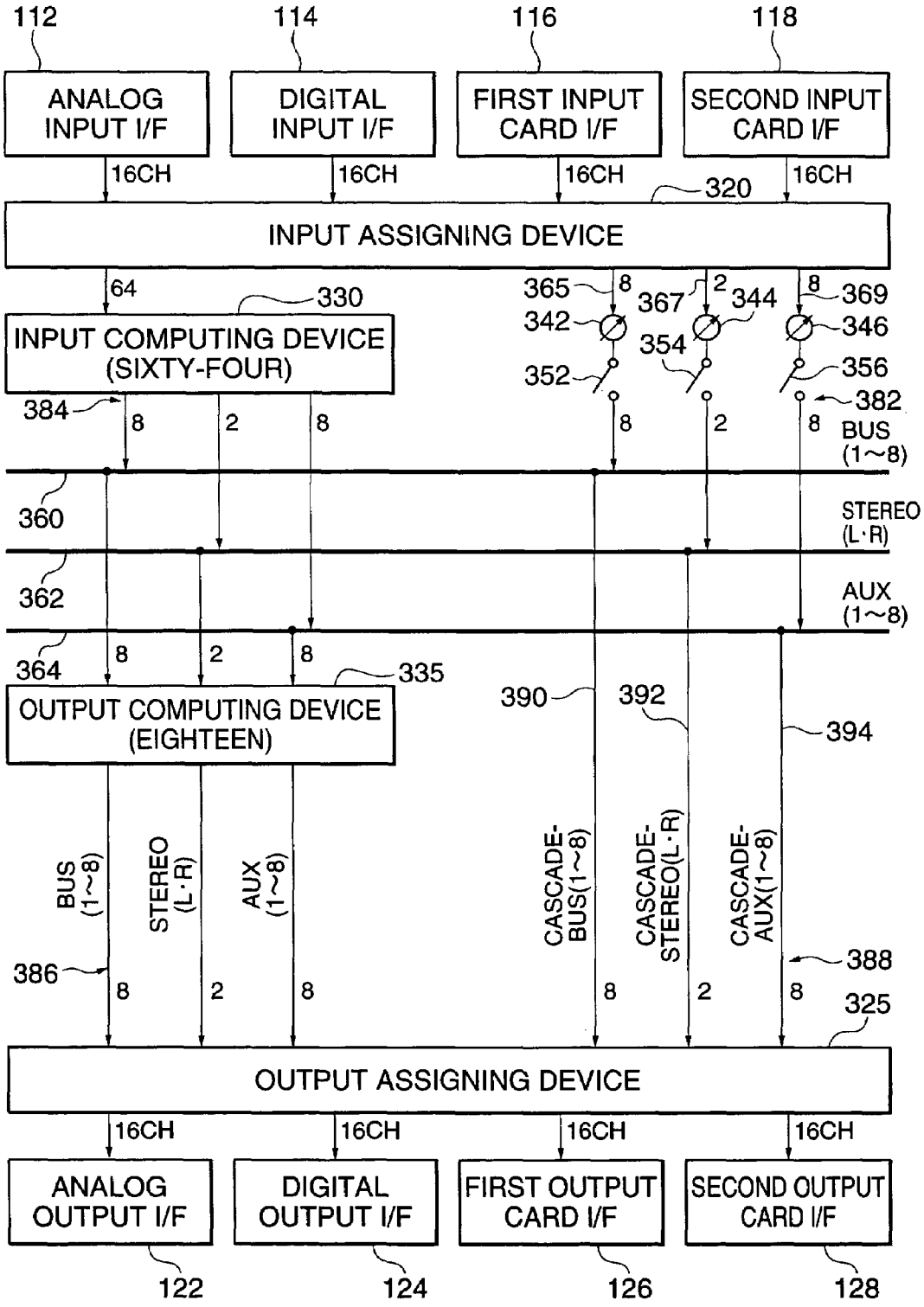
FIG. 3 is a diagram-showing the structure of a mixing algorithm that is implemented by a DSP 20, a CPU 50, and so forth appearing in FIG. 1.

Referring to FIG. 3, the analog input interface 112 drives the A/D converter 113 (FIG. 2) to convert analog audio signals for sixteen channels to digital audio signals. The digital input interface 114 provides interface for inputting digital audio signals for sixteen channels. Each of the first and second input card interfaces 116 and 118 provides interface for inputting digital audio signals for sixteen channels. In the following, the above described component parts 112, 114, 116, and 118 will be generically referred to as "the input interfaces".

Reference numeral 320 denotes an input assigning device, which assigns a plurality of audio signals (input signals) input via the input interfaces 112, 114, 116, and 118 to input computing devices 330 and a cascade input signal line group 382 (365, 367, and 369) according to settings of the input assigning device 320 made in advance by an operator. Note that reference numeral 365 denotes lines for a bundle of cascade BUS input signals, i.e. a group of cascade BUS signals for eight channels; 367, lines for a bundle of cascade STEREO input signals, i.e. cascade STEREO signals for an L channel and an R channel; and 369, lines for a bundle of cascade AUX (auxiliary) signals, i.e. a group of cascade AUX signals for eight channels. Therefore, among audio signals input to the input assigning device 320, cascade signals are assigned to the cascade signal line group 382. Signals other than the cascade signals are handled as direct input signals.

Further, attenuators 342, 344, and 346 are provided in the cascade signal line group 382, to attenuate respective cascade input signals. Switches 352, 354, and 356 are also provided, which are turned on when mixing cascade input signals and are turned off when not mixing cascade input signals. The attenuators 342, 344, and 346 and the switches 352, 354, and 356 are provided for eighteen channels in total.

Although FIG. 3 illustrates only one input computing device 330 for the convenience of explanation, the same number of input computing devices 330 as the maximum number of (sixty-four) input signals are actually provided, and one input signal is assigned to each of the input computing devices 330. The input computing devices 330 each perform a predetermined arithmetic operation on an input signal assigned thereto, and output the resulting signals to eighteen mix buses (360, 362, and 364). Note that reference numeral 360 denotes a BUS line for a group of signals for eight channels to be mixed; 362, a STEREO line for a group of signals for an L channel and an R channel to be mixed; and 364, an AUX line for a group of signals for eight channels to be mixed, which is provided for auxiliary use. Therefore, the number of signals in the mix buses is equal to the number of signals included in the cascade signal line group 382. The signals in the mix buses are mixed with signals from an output signal line group 384 from the input computing devices 330 by the mix buses.

A description will now be given of the internal algorithm of each input computing device 330 with reference to FIG. 4.

Each of the input computing devices 330 is provided with computing devices 331, which adjust the characteristics of input signals and correspond in number to the number of the (eighteen) mix buses. The computing devices 331 are connected to respective channels of the mix buses. Each of the computing devices 331 is comprised of an equalizer device (EQ) 332, a delay device (DL) 334, a switch 336, and an attenuator 338, and adjusts the characteristics of each input signal assigned to the input computing device 330. The equalizer device 332 gives frequency characteristics to an input signal (direct input signal), and the delay device 334 delays the input signal (direct input signal) by a predetermined period of time. The predetermined period of time is equal to the sum of a first delay time intended for overcoming a tone delay occurring in dependence on the distance between a tone collector such as a microphone and a tone generation source, and a second delay time intended for eliminating a difference in time (phase difference) between a tone captured directly from a microphone or the like (direct input signal) and a tone input via cascade connection (cascade input signal). Namely, a direct input signal is delayed so that it coincides in phase to a cascade input signal. The switch 336 is used for selecting whether the input signal is to be transmitted to the mix bus or not. The attenuator 338 is used for attenuating the input signal.

The output signals for eighteen channels from the input computing devices 330 are transmitted via the input computing device output signal line group 384 to respective eighteen channels of the mix buses (360, 362, and 364). Therefore, a delayed direct input signal and a cascade signal are mixed by each of the mix buses for eighteen channels, so that mixed signals for eighteen channels can be generated. It should be noted that the cascade signals via the cascade signal line group 382 are transmitted to the mix buses. For example, a first channel signal via the cascade BUS input signal bundle lines 365 is transmitted to the first channel of the BUS line 360. Further, in FIG. 3, reference numeral 388 denotes a cascade output signal line group, which consists of cascade BUS output signal bundle lines 390, cascade STEREO output signal bundle lines 392, and cascade AUX output signal bundle lines 394. The cascade BUS output signal bundle lines 390 are cascade BUS signal group lines for eight channels. The cascade STEREO output signal bundle lines 390 are lines for a group of cascade STEREO signals for an L channel and an R channel. The cascade AUX output signal bundle lines 394 are lines for a group of cascade AUX signals for eight channels.

Figure 4:
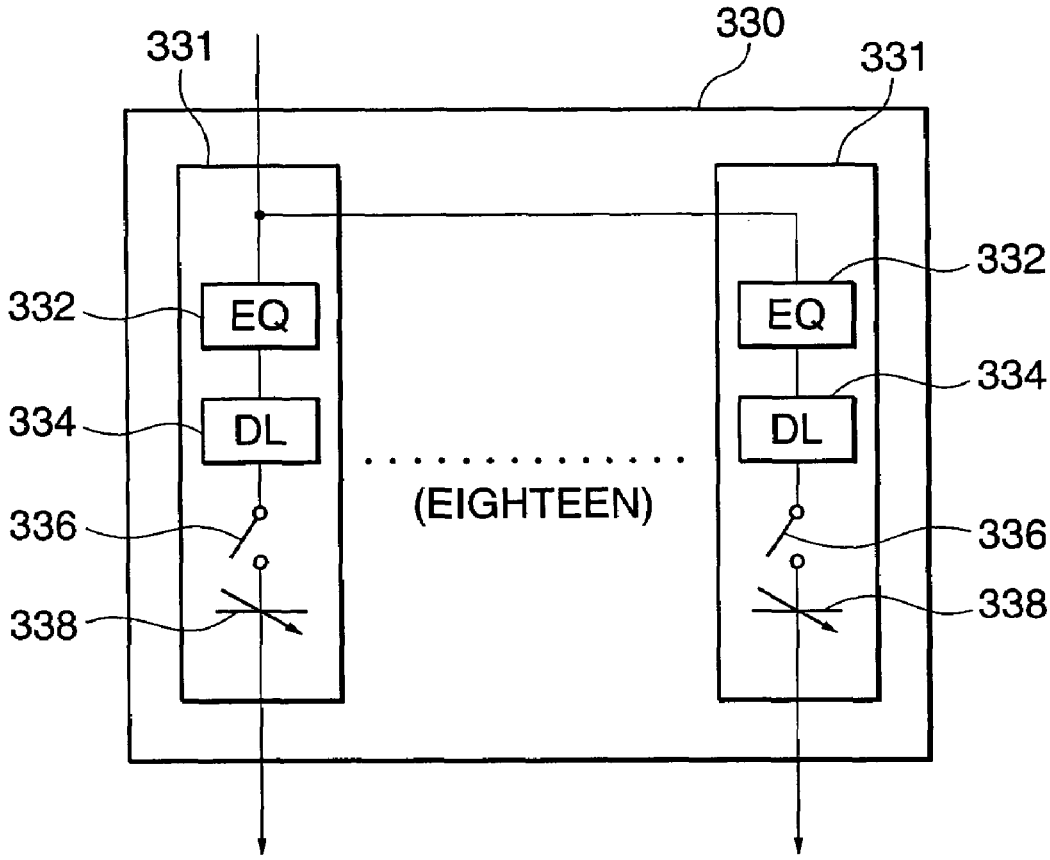
FIG. 4 is a diagram showing the structure of an internal algorithm of one input computing device 330 appearing in FIG. 3.

Reference numeral 335 denotes output computing devices, whose internal algorithm is identical in structure with the internal algorithm of the input computing devices 330 appearing in FIG. 4, and which each perform an arithmetic operation on each signal from the mix buses (360, 362, and 364). Although FIG. 3 illustrates only one output computing device 335 for the convenience of explanation, eighteen output computing devices 335 are actually provided for eighteen channels corresponding in number to the number of signals in the mix buses. However, only one set of the equalizer device 332, the delay device 334, the switch 336, and the attenuator 338 included in each of the computing devices 331 of the output computing devices 335 is used for each channel, and is not used for mixing. Reference numeral 386 denotes an output computing device output signal line group, i.e. lines for a group of output signals which are obtained by performing arithmetic operations on respective signals in the mix buses by the output computing devices 335.

The analog output interface 122 causes the D/A converter 123 thereof to perform processing on output signals for sixteen channels, and the digital output interface 124 provides interface for outputting signals for sixteen channels. The first and second output card interfaces 126 and 128 provide interface for outputting signals for sixteen channels for each card. In the following, the component parts 122, 124, 126, and 128 will be generically referred to as "the output interfaces". Reference numeral 325 denotes an output assigning device, which selects signals from the output computing device output line group 386 and the cascade output line group 388 according to settings of the output assigning device 325 made in advance by the operator, and assigns the selected signals to channels of the component parts 122, 124, 126, and 128.

Further, in the case where the mixing apparatus 100 according to the present embodiment is connected in cascade to one or more other mixing apparatuses, a cascade signal output from an upstream mixing apparatus is input to the mixing apparatus 100 via any input terminal of the input interfaces 112, 114, 116, and 119. Further, a signal output via any output terminal of the output interfaces 122, 124, 126, and 128 of the mixing apparatus 100 is input as a cascade signal to a downstream mixing apparatus. Therefore, any of mixed signals for eighteen channels is output as a cascade signal. It should be noted that not only digital mixing apparatuses but also analog mixing apparatuses may be connected in cascade.

A description will now be given of the operation of the mixing apparatus 100 according to the present embodiment with reference to FIGS. 1 to 3.

When the operator selects a cascade connection mode from control modes of the mixing apparatus 100 displayed in the display section 40, an input setting screen view for setting which of the channels of the input interfaces 112, 114, 116, and 118 are to be assigned to the respective channels of the mix buses (i.e. the BUS line 360, the STEREO line 362, and the AUX line 364) is displayed in the display section 40.

At least one input audio signal input from at least one of the channels (i.e., input terminals) of the input interfaces 112, 114, 116, and 118, which are assigned to the respective channels of the mix buses (i.e. the BUS line 360, the STEREO line 362, and the AUX line 364), is set as at least one cascade signal.

Figure 5A:
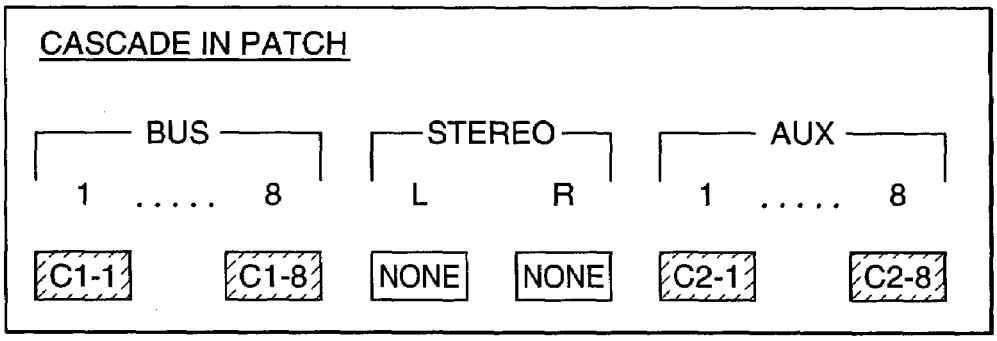

Then, signals input via the respective input interfaces 112, 114, 116, and 118 are set for the respective channels of the mix buses (i.e. the BUS line 360, the STEREO line 362, and the AUX line 364). Particularly in the case where there are any signals input via cascade connection, a CASCADE_IN-_PATCH setting screen view appearing in FIG. 5A is displayed in the display section 40, and the respective input signals (cascade input signals) are assigned to respective corresponding channels of the cascade BUS input signal bundle lines 365, the cascade STEREO signal bundle lines 367, and the cascade AUX input signal bundle lines 369. From the left side as viewed in FIG. 5A, first to eighth channels are set for the cascade BUS input signal bundle lines 365, L and R channels are set for the cascade STEREO input signal bundle lines 367, and first to eighth channels are set for the cascade AUX input signal bundle lines 369. In FIG. 5A, "C1-n" indicates an input to the nth channel of a card 1, and "C2-n" indicates an input to the nth channel of a card 2. "NONE" indicates that there is no input, and hatched lines indicate that an input is effective (for example, a card is inserted).

In FIG. 5A, it is seen that the first channel of the first input card interface 116 is set for the first channel of the cascade BUS input signal bundle lines 365, and similarly, the second to eighth channels of the first input card interface 116 are set for the second to eighth channels of the cascade BUS input signal bundle lines 365. Also, the first channel of the second input card interface 118 is set for the first channel of the cascade AUX input signal bundle lines 369, and similarly, the second to eighth channels of the second input card interface 118 are set for the second to eighth channels of the cascade AUX input signal bundle lines 369. It should be noted that nothing is set for the cascade STEREO input signal bundle lines 367.

Figure 5B:
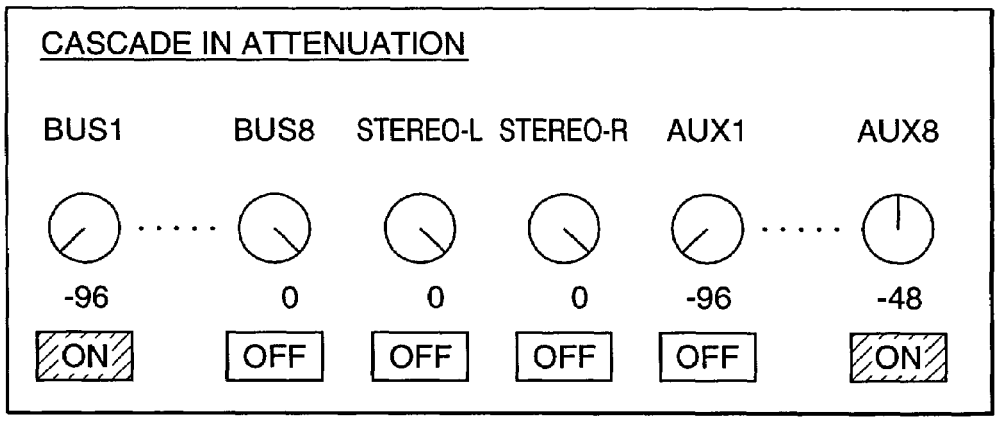

Next, settings as to the amount of attenuations in the input computing devices 330 and the cascade signal line group 382 and settings as to mixing are made. Particularly in the case where the mixing apparatus 100 is connected in cascade to one or more other mixing apparatuses, a CASCADE_IN-_ATTENUATION setting screen view appearing in FIG. 5B is displayed in the display section 40 to set the amounts of attenuation or make switch settings. From the left side as viewed In FIG. 5B, amounts of attenuation are set for the first to eighth channels of the cascade BUS input signal bundle lines 365, amounts of attenuation are set for the L channel and the R channel of the cascade STEREO input signal bundle lines 3, and amounts of attenuation are set for the first to eighth channels of the cascade AUX input signal bundle lines 369. In FIG. 5B, "ON" indicates an ON state of the switches 352, 354, and 356 corresponding to the respective channels, and "OFF" indicates an OFF state of the switches 352, 354, and 356 corresponding to the respective channels.

In FIG. 5B, it is seen that the amount of attenuation for the first channel in the cascade BUS input signal bundle lines 365 is set to "−96 dB" with the corresponding switch being ON, and the amount of attenuation for the eighth channel of the cascade BUS input signal bundle lines 365 is set to "0 dB" which means that no attenuation is carried out, but the corresponding switch is OFF. Also, the amount of attenuation for the eighth channel of the cascade BUS input signal bundle lines 365 is set to "0 dB", which means that no attenuation is carried out, but the corresponding switch 354 is OFF. Further, the amount of attenuation for the first channel of the cascade AUX input signal bundle lines 369 is set to "−96 dB" with the corresponding switch being OFF, and the amount of attenuation for the eighth channel of the cascade AUX input signal bundle lines 369 is set to "−48 dB" with the corresponding switch being ON.

Figure 5C:
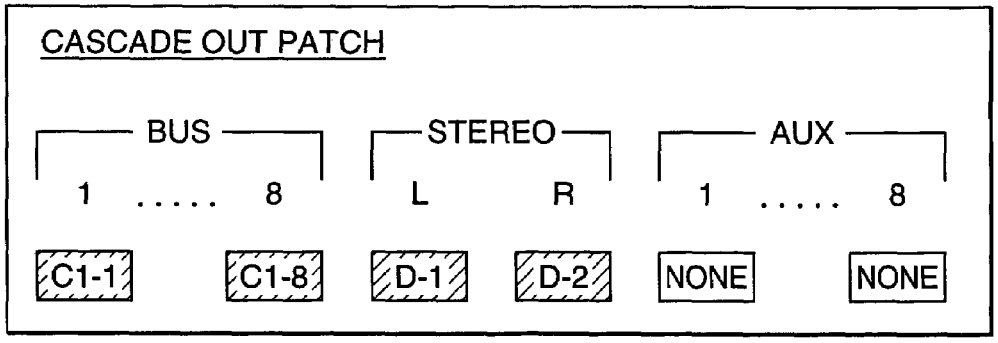

Next, a screen view for setting as to assignment of outputs from the output computing device output signal line group 386 and the cascade output signal line group 388 is displayed in the display section 40. Particularly in the case where the mixing apparatus 100 is connected in cascade to one or more other mixing apparatuses, a CASCADE_OUT-_PATCH setting screen view appearing in FIG. 5C is displayed in the display section 40. From the left side as viewed In FIG. 5C, outputs for the first to eighth channels of the cascade BUS output signal bundle lines 390 are set, outputs for the L channel and the R channel of the cascade STEREO output signal bundle lines 392 are set, and outputs for the first to eighth channels of the cascade AUX output signal bundle lines 394 are set. In FIG. 5C, "C1-n" indicates the nth channel of the first output card interface 126, "D-n" indicates the nth channel of the digital output card interface 124, and "NONE" indicates that nothing is connected.

In FIG. 5C, it is seen that the first channel of the cascade BUS output signal bundle lines 390 is set for the first channel of the first output card interface 126, and similarly, the second to eighth channels of the cascade BUS output signal bundle lines 390 are set for the first to eighth channels of the first output card interface 126. Also, the L output of the cascade STEREO output signal bundle lines 392 in the is set for the first channel of the digital output interface 124, and the R output of the cascade stereo output signal bundle lines 392 is set for the second channel of the digital output interface 124. It should be noted that no output setting is made for the first to eighth channels of the cascade AUX output signal bundle lines 394.

The mixing process is carried out by the DSP 20. The input assigning device 320 assigns signals input via the respective input interfaces 112, 114, 116, and 118 as respective input signals (direct input signals) of the input computing devices 330 or respective input signals (cascade input signals) of the cascade signal line group 382, according to settings made in the input assignment screen view. The cascade input signals are input to any of the input interfaces 112, 114, 116, and 118, and the direct input signals are input to the other ones of the input interfaces 112, 114, 116, and 118.

In the input computing device 330, a large number of (i.e. eighteen) equalizer devices 332 give frequency characteristics to respective direct input signals for respective channels, and a large number of (i.e. eighteen) attenuators 338 attenuate the respective direct input signals. Further, the sum of a first delay time intended for overcoming a tone delay occurring in dependence on the distance between a tone collector (such as a microphone) and a tone generation source and a second delay time intended for eliminating a difference in time between a direct input signal and a cascade input signal is set for each of a large number of (i.e. eighteen) delay devices 334. Here, correction for a delay caused by cascade connection is carried out in order to eliminate a difference in signal phase (synchronize) between the cascade signal line group 382 and the input computing device output signal line group 384. Specifically, in the case where two mixing apparatuses 100 are connected in cascade via input cards and output cards, the delay time of the mixing apparatus 100 on the downstream side is set as follows by default, for example. Specifically, the delay time of the mixing apparatus 100 on the downstream side is set to be equal to the total sum of times of delay caused by the input card interface of the mixing apparatus 100 on the downstream side, the input assigning device 320, output computing device 335, output assigning device 325, and output card interface of the mixing apparatus 100 on the upstream side. According to settings of the input computing devices 330 made in advance by the operator, output signals for respective channels are output from the input computing devices 330 to the mix buses (the BUS line 360, the STEREO line 362, and the AUX line 364), and are mixed according to the set amounts of attenuation.

On the other hand, the respective signals (cascade input signals) of the cascade signal line group 382 are attenuated for each channel by the attenuators 342 for eight channels, the attenuators 344 for two channels, and the attenuators 346 for eight channels. Further, the respective signals (cascade input signals) of the cascade signal line group 382 are controlled to be turned on/off by the switches 352 for eight channels, the switches 354 for two channels, and the switches 356 for eight channels, and are mixed with the output signals from the input computing devices 330 in the mix buses (360, 362, and 364) for eighteen channels.

The mixed signals are input to the output computing devices 335, so that frequency characteristics are given to each of the mixed signals, and gain adjustment or the like is carried out for each of the mixed signals. The resulting signals are output as respective signals from the output computing device output signal line group 386. Further, the output assigning device 325 assigns respective signals (cascade output signals) from the cascade output signal line group 388 and respective signals (direct output signals) from the output computing device output signal line group 386 as signals to be outputted from any one of the output interfaces 122, 124, 126, and 128. As a result, the cascade output signals are output from one of the output interfaces 122, 124, 126, and 128 via the output terminals thereof, and the direct output signals are output from one of the other output interfaces 122, 124, 126, and 128 via output terminals thereof.

It is to be understood that the present invention is not limited to the embodiment described above, but various variations of the above described embodiment may be possible without departing from the spirits of the present invention, including variations as described below, for example.

Although in the above described embodiment, the sum of the first delay time intended for overcoming a tone delay occurring in dependence on the distance between a tone collector (such as a microphone) and a tone generation source and the second delay time intended for eliminating a difference in time between a direct input signal and a cascade input signal is set in the input computing device 330, the present invention is not limited to this, but the second delay time may be set in the cascade signal line group 382 by means of an additional delay device, and the first delay time may be set in the input computing device 330.

Although in the present embodiment, the mixing method which is executed by the mixing apparatus 100 is implemented by the program stored in the ROM 70, it goes without saying that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention.

The storage medium for supplying the program code is not limited to a ROM, and a floppy (registered trademark) disk, a hard disk, an optical disk, a magnetic-optical disk, a CD-ROM, a CD-R, a CD-RW, a DVD-ROM, a DVD-RAM, a DVD−RW, a DVD+RW, a magnetic tape, a nonvolatile memory card, and a download carried out via a network may be used.

Further, it goes without saying that the functions of the above described embodiment may be accomplished not only by executing the program code read out by a computer, but also by causing an OS (operating system) or the like which operates on the computer to perform a part or all of the actual operations based on instructions of the program code.

Further, it goes without saying that the functions of the above described embodiment may be accomplished by writing the program code read out from the storage medium into a memory provided in an expansion board inserted into a computer or a memory provided in an expansion device connected to the computer and then causing a CPU or the like provided in the expansion board or the expansion device to perform a part or all of the actual operations based on instructions of the program code.

What is claimed is:

1. A mixing method executed by a first mixing apparatus including a plurality of input terminals and a second mixing apparatus connected in cascade to at least one of the input terminals of the first mixing apparatus, comprising: an input setting step of setting at least one audio signal input from the second mixing apparatus to said at least one input terminal as at least one cascade signal; an input computing step of performing arithmetic operations on at least one audio signal input to at least another input terminal; and a signal mixing step of mixing the at least one cascade signal and the at least one audio signal on which the arithmetic operations have been performed in said input computing step; wherein said at least one input terminal is nonexclusive to a cascade input.

2. A mixing method according to claim 1, wherein said input computing step comprises a delaying step of performing a delay process for correcting a time of delay from the second mixing apparatus to the first mixing apparatus.

3. A mixing method executed by a second mixing apparatus connected in cascade to at least one input terminal of a first mixing apparatus, comprising:

a mixing step of mixing a plurality of input signals to output a plurality of output signals;

an output setting step of setting at least one of the plurality of output signals as at least one cascade signal to be supplied to the first mixing apparatus;

a computing and outputting step of performing arithmetic operations on at least another output signal, and outputting the at least another output signal on which the arithmetic operations have been performed to the first mixing apparatus; and a cascade outputting step of directly outputting the at least one of the plurality of output signals set as the cascade signal to the first mixing apparatus from an output terminal, wherein said output terminal is nonexclusive to a cascade output.

4. A mixing apparatus including a plurality of input terminals, at least one of the input terminals being connected in cascade to a second mixing apparatus, comprising:

an input setting device that sets an audio signal input from the second mixing apparatus and received by the at least one input terminal as at least one cascade signal;

an input computing device that performs arithmetic operations on at least another audio signal received at an input terminal other than the at least one input terminal; and a signal mixing device that mixes the at least one cascade signal and the at least another audio signal on which the arithmetic operations have been performed by said input computing device, wherein the at least one input terminal is nonexclusive to a cascade input.

5. A mixing apparatus according to claim 4, wherein said input computing device comprises a delaying device that performs a delay process for correcting a time of delay from the other mixing apparatus to the mixing apparatus.

6. A mixing apparatus including a plurality of input terminals, at least one of the input terminals being connected in cascade to another mixing apparatus, comprising:

a mixing device that mixes a plurality of input signals to output a plurality of output signals;

an output setting device that sets at least one of the plurality of output signals as at least one cascade signal to be supplied to the other mixing apparatus;

a computing and output device that performs arithmetic operations on at least another output signal, and outputs the at least another output signal on which the arithmetic operations have been performed to the other mixing apparatus; and a cascade outputting device that directly outputs the at least one output signal set as the cascade signal to the other mixing apparatus, from an output terminal, wherein said output terminal is nonexclusive to a cascade output.

7. A program executed by a computer to cause a first mixing apparatus, including a plurality of input terminals and a second mixing apparatus connected in cascade to at least one of the input terminals of the first mixing apparatus, to execute a mixing method, the program comprising: an input setting module for setting at least one audio signal input from the second mixing apparatus to said at least one input terminal as at least one cascade signal; an input computing module for performing arithmetic operations on at least one audio signal input to at least another input terminal; and a signal mixing module for mixing the at least one cascade signal and the at least one audio signal on which the arithmetic operations have been performed by said input computing module; wherein said at least one input terminal is nonexclusive to a cascade input.

8. A program according to claim 7, wherein said input computing module comprises a delaying module for performing a delay process for correcting a time of delay from the second mixing apparatus to the first mixing apparatus.

9. A program executed by a computer to cause a second mixing apparatus connected in cascade to at least one input terminal of a first mixing apparatus to execute a mixing method, the program comprising:

a mixing module for mixing a plurality of input signals to output a plurality of output signals;

an output setting module for setting at least one of the plurality of output signals as at least one cascade signal to be supplied to the first mixing apparatus;

a computing and outputting module for performing arithmetic operations on at least another output signal, and outputting the at least another output signal on which the arithmetic operations have been performed to the first mixing apparatus; and a cascade outputting module for directly outputting the at least one of the plurality of output signals set as the cascade signal to the first mixing apparatus, from an output terminal, wherein said output terminal is nonexclusive to a cascade output.

* * * * *